US011667491B2

(12) United States Patent
Matsuki

(10) Patent No.: US 11,667,491 B2
(45) Date of Patent: Jun. 6, 2023

(54) SHEET POST-PROCESSING APPARATUS

(71) Applicant: Satoru Matsuki, Yamanashi (JP)

(72) Inventor: Satoru Matsuki, Yamanashi (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 17/728,269

(22) Filed: Apr. 25, 2022

(65) Prior Publication Data

US 2022/0348433 A1 Nov. 3, 2022

(30) Foreign Application Priority Data

Apr. 28, 2021 (JP) ..... JP2021-075601
Apr. 25, 2022 (JP) ..... JP2022-071293

(51) Int. Cl.

*B65H 45/20* (2006.01)
*B65H 37/06* (2006.01)
*B65H 37/04* (2006.01)
*B65H 45/18* (2006.01)

(52) U.S. Cl.

CPC ..... *B65H 37/06* (2013.01); *B65H 37/04* (2013.01); *B65H 45/18* (2013.01); *B65H 2301/17* (2013.01)

(58) Field of Classification Search

CPC ..... B31F 1/10; B65H 37/04; B65H 37/06; B65H 2301/17; B65H 45/20
USPC ..... 270/37; 493/435, 444
See application file for complete search history.

(56) References Cited

U.S. PATENT DOCUMENTS 7,111,837 B2 * 9/2006 Itou ..... B65H 45/14 270/32
7,850,155 B2 * 12/2010 Mizubata ..... G03G 15/6538 270/32
8,292,283 B2 * 10/2012 Matsuno ..... G03G 15/6582 270/32
8,573,590 B2 * 11/2013 Shimizu ..... B65H 37/04 270/37
8,900,110 B2 * 12/2014 Jung ..... B65H 45/18 493/360
11,021,340 B2 * 6/2021 Kishimoto ..... B65H 37/04
11,021,341 B2 * 6/2021 Kishimoto ..... B65H 37/06

(Continued)

FOREIGN PATENT DOCUMENTS

JP 2002-060127 A 2/2002
JP 2004-099199 A 4/2004
JP 2006-056669 A 3/2006

*Primary Examiner* — Leslie A Nicholson, III
(74) *Attorney, Agent, or Firm* — Manabu Kanesaka

(57) ABSTRACT

The present invention is to enable folding processing to be applied to also large sheet sizes without upsizing the entire apparatus, in the sheet post-processing apparatus for performing the folding processing and binding processing on sheets, a sheet post-processing apparatus is provided with a binding processing section for performing binding processing using a binding needle on a sheet bunch inside a storage section, first folding roller pair for nipping a sheet P inside the storage section in a first position to form a first fold portion, a receiving section for receiving the sheet with the first fold portion formed fed out of the first folding roller pair, and second folding roller pair for nipping the sheet inside the receiving section in a second position to form a second fold portion.

6 Claims, 14 Drawing Sheets

(56) References Cited

U.S. PATENT DOCUMENTS

| | | | | |
|---|---|---|---|---|
| 11,077,694 | B2 * | 8/2021 | Noso | G03G 15/6544 |
| 2013/0087965 | A1 * | 4/2013 | Shimizu | B65H 45/18 270/45 |

* cited by examiner

SHEET POST-PROCESSING APPARATUS

TECHNICAL FIELD

The present invention relates to a sheet post-processing apparatus for performing folding processing and binding processing on sheets.

BACKGROUND ART

Conventionally, there have been widely known post-processing apparatuses which perform folding processing such as two-fold and three-fold on a sheet with an image formed by an image forming apparatus such as a copier and printer, and then, discharge (e.g., see Patent Documents 1, 2).

Further, in addition to the section for performing the folding processing on a sheet, there is a known post-processing apparatus provided with a section for making a plurality of image-formed sheets as a sheet bunch, and performing binding processing with binding needles made of metal (e.g., see Patent Document 3).

PRIOR ART DOCUMENT

Patent Document

[Patent Document 1] Japanese Unexamined Patent Publication No. 2002-60127

[Patent Document 2] Japanese Unexamined Patent Publication No. 2004-99199

[Patent Document 3] Japanese Unexamined Patent Publication No. 2006-56669

DISCLOSURE OF INVENTION

Problems to be Solved by the Invention

Sheets subjected to the folding processing by the post-processing apparatus are often used as postal mails sealed in envelopes or distribution by mail delivery and the like. In the case of the postal mail, sheet sizes suitable for folding in three to put in a standard-sized envelope are usually an A4 size (length of 297 mm) or less. However, recently, in order to use advertisement goods such as pamphlets folded in three, enlarge fonts for ease-to-read and increase an information amount of space, upsizing (e.g., B4 size, A3 size and so on exceeding the A4 size) has been required in sheet size to perform the folding processing.

However, in the conventional apparatuses described in the above-mentioned Patent Documents, in upsizing the sheet size allowed to undergo the folding processing, there is the risk that the entire post-processing apparatus is increased in size. This is contrary to user requirements to make the image forming apparatus and post-processing apparatus itself compact.

The present invention was made in view of the issue of the above-mentioned conventional techniques, and it is an object of the invention to enable folding processing to be applied to also large sheet sizes exceeding the conventional A4 size (length of 297 mm) without upsizing the entire apparatus, in the sheet post-processing apparatus for performing the folding processing and binding processing on sheets.

Means for Solving the Problem

A sheet post-processing apparatus of the present invention is provided with a conveying section for conveying a sheet in a predetermined conveyance direction, a storage section for storing sheets conveyed by the conveying section, a binding section for applying binding processing using a binding needle to a sheet bunch formed from a plurality of sheets stored in the storage section, a needle storage section detachably attached to the binding section to store the binding needle supplied to the binding section, a first folding roller pair for nipping a sheet or the sheet bunch stored in the storage section in a predetermined first position in the conveyance direction, and thereby forming a first fold portion in the first position, a receiving section for receiving the sheet or the sheet bunch with the first fold portion formed by the first folding roller pair, and a second folding roller pair for nipping the sheet or the sheet bunch with the first fold portion formed inside the receiving section in a second position different from the first position, and thereby forming a second fold portion in the second position, where the first folding roller pair and the second folding roller pair are disposed on the same side as the needle storage section attached to the binding section with respect to the storage section, below the needle storage section, in a thickness direction of the sheet or the sheet bunch stored in the storage section, and the receiving section is disposed above the first folding roller pair and the second folding roller pair so as to sandwich the needle storage section between the storage section and the receiving section, in a position crossing a locus of the needle storage section being removed from the binding section to add the binding needle.

Advantageous Effect of the Invention

According to the present invention, by arranging the storage section and the receiving section below the binding section and the needle storage section as described above, without upsizing the entire apparatus, it is possible to provide the sheet post-processing apparatus capable of performing the folding processing on larger sheet sizes.

MODE FOR CARRYING OUT THE INVENTION

Suitable Embodiments of the present invention will be described below in detail with reference to accompanying drawings. In addition, in order to simplify explanations, in this Description, in the accompanying drawings (particularly, FIGS. 1 to 4), it is assumed that the right side and left side in the figure are simply called the right side and left side, the upper side and lower side in the figure are simply called the upper side and lower side, and that the paper front side and paper back side of each drawing are simply called the front side and the back side.

[Entire Configuration of a Sheet Post-Processing Apparatus]

Figure 1:
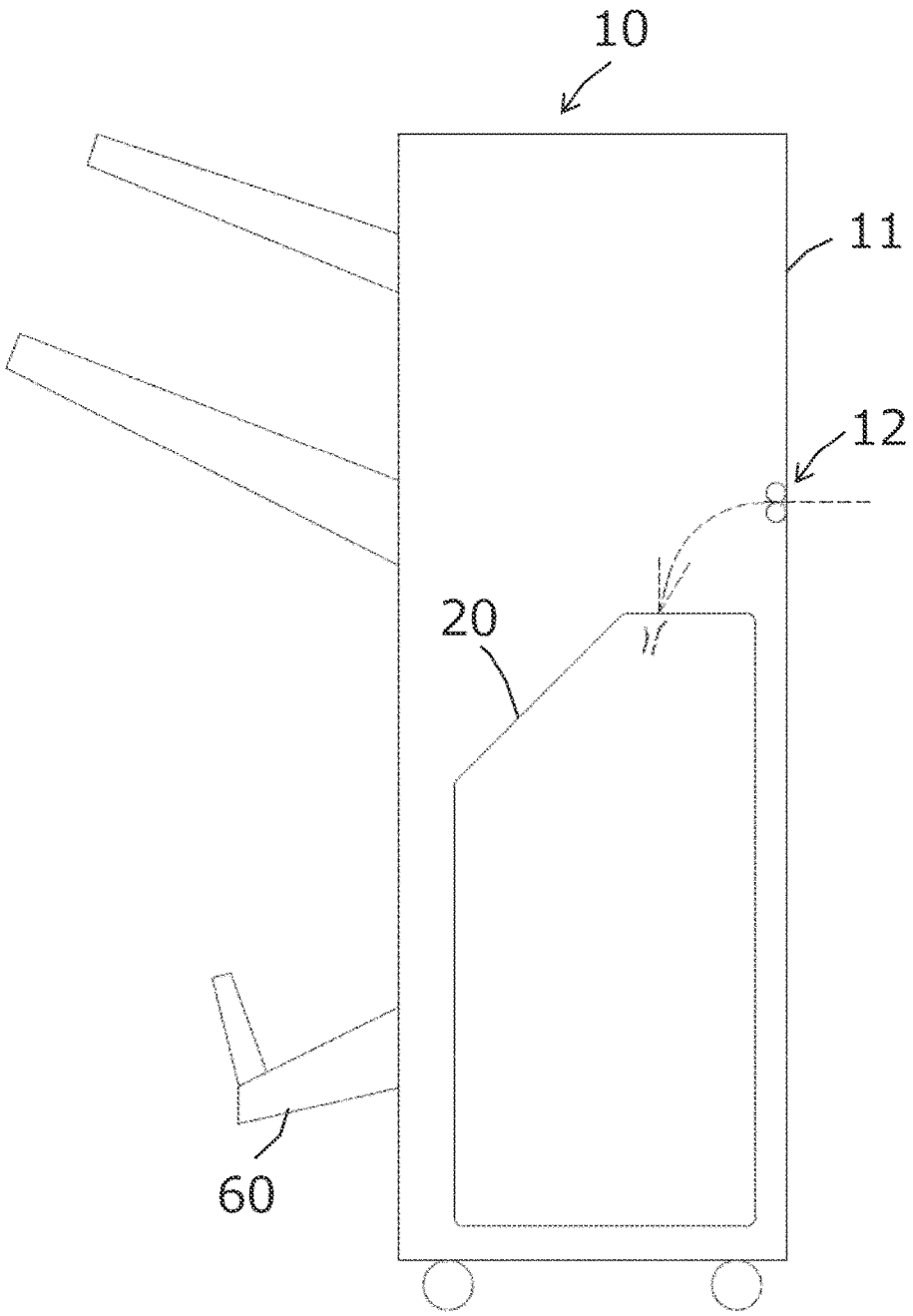
FIG. 1 is an entire configuration view of a sheet post-processing apparatus according to a suitable Embodiment of the present invention.

The entire configuration of a sheet post-processing apparatus 10 will be described. FIG. 1 schematically illustrates the entire configuration of the sheet post-processing apparatus 10. The sheet post-processing apparatus 10 is connected to an image forming apparatus such as a copier and printer to use, and performs folding processing, binding processing using a staple as a binding needle and the like on printed sheets P output from the image forming apparatus.

As shown in FIG. 1, the sheet post-processing apparatus 10 is provided with a main body 11, take-in roller pair 12, sheet binding folding processing section 20, and sheet discharge tray 60. The main body 11 is a housing of the sheet post-processing apparatus 10, and the take-in roller pair 12 and sheet binding folding processing section 20 are stored inside the housing.

The take-in roller pair 12 is positioned in the vicinity of a side face on the right side of the main body 11, and takes a printed sheet P output from the image forming apparatus in the main body 11. As indicated by dashed lines, the sheet P taken in the main body 11 by the take-in roller pair 12 is conveyed to the sheet binding folding processing section 20 by roller pairs and guide not shown in the figure. The sheet discharge tray 60 is arranged on the left side of the main body 11 i.e. on a side face on the side opposite to the image forming apparatus.

It is preferable that the sheet binding folding processing section 20 is capable of being pulled outside from the main body 11 for jam processing when a jam of a sheet occurs inside the section, operation for adding binding needles used in the binding processing and the like. Therefore, the sheet binding folding processing section 20 of this Embodiment is provided to be able to shift between an operating position disposed inside the main body 11 and a maintenance position configured outside the main body 11 on the front side in the figure.

Herein, the operating position refers to a position in which the sheet binding folding processing section 20 is capable of executing predetermined binding processing and folding processing on sheets conveyed to the sheet binding folding processing section 20. The maintenance position refers to a position in which the sheet binding folding processing section 20 is pulled outside from the main body 11 to remove a jammed sheet in the case where the jam of the sheet occurs in the process of performing the binding processing or the binding processing in the sheet binding folding processing section 20. In the maintenance position, it is also possible to perform operation for refilling the sheet binding folding processing section 20 with binding needles used in the binding processing.

[Sheet Binding Folding Processing Section]

Figure 2B:
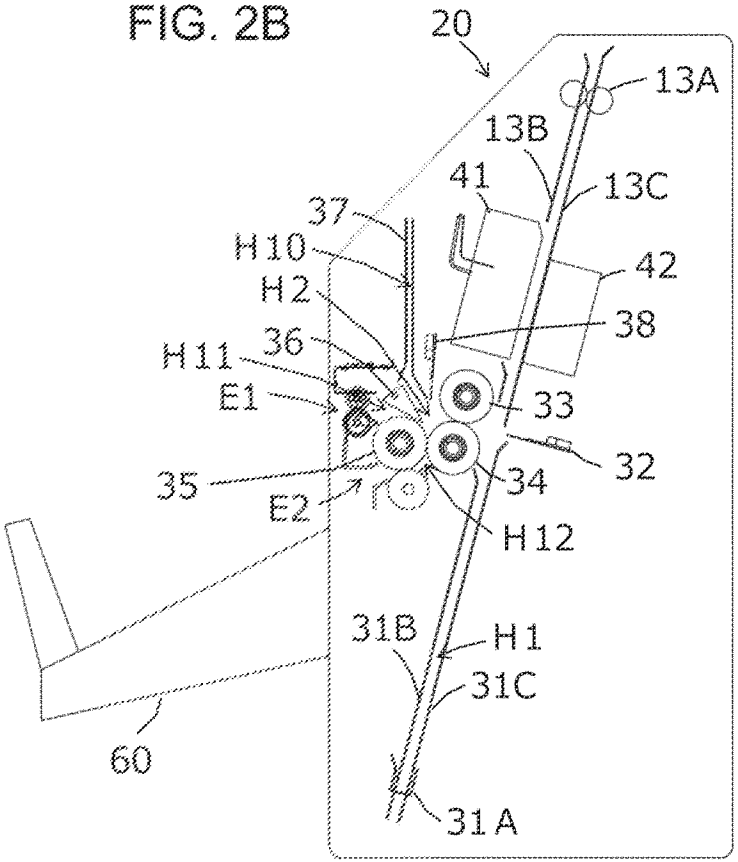
FIG. 2B is a more detailed explanatory view of the configuration of the sheet binding folding processing section.
Figure 2A:
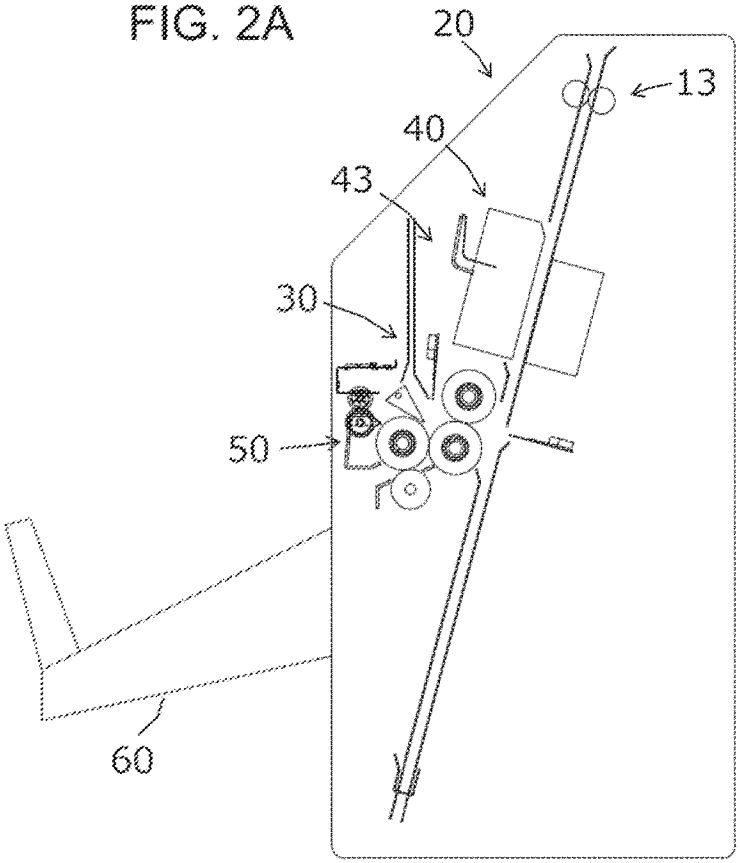
FIG. 2A is an explanatory view of an entire configuration of a sheet binding folding processing section of FIG. 1.

FIGS. 2A and 2B illustrate a configuration of the sheet binding folding processing section 20 for applying desired folding processing and/or binding processing to the sheet P. The sheet binding folding processing section 20 is comprised of a conveying section 13 for conveying the taken-in sheet P in a predetermined sheet conveyance direction, a folding processing section 30 for applying the folding processing to the conveyed sheet P, and a binding processing section 40 for applying the binding processing to the conveyed sheet P. The conveying section 13 is comprised of an upper guide 13B and upper guide 13C disposed to be opposed so as to define a sheet conveyance path in which the sheet P is conveyed, and an entrance roller pair 13A disposed in an upper entrance of the sheet conveyance path. The sheet P conveyed to the sheet binding folding processing section 20 is conveyed in the sheet conveyance path by the entrance roller pair 13A, and is collected in a storage section H1 continued to the sheet conveyance path.

The storage section H1 is comprised of a lower guide 31B and lower guide 31C disposed to be opposed so as to define a gap for storing the sheet P therebetween. On the downstream side of the storage section H1 in the sheet conveyance direction is provided a first stopper 31A for regulating a lower end position of the sheet P. The first stopper 31A strikes a front end (lower end) of the sheet P in the sheet conveyance direction, and performs positioning of the sheet P stored in the storage section H1 in the sheet conveyance direction with respect to the storage section H1. The lower end of the sheet P is regulated by the first stopper 31A, and a position of a first fold formed in the sheet is thereby determined. Corresponding to a sheet size of the sheet P and the formation position of the first fold, the first stopper 31A is capable of shifting in the sheet conveyance direction and opposite direction.

The binding processing section 40 that is a section for binding a sheet bunch comprised of a plurality of sheets has a head portion 41 for hitting the binding needle (staple) into the sheet bunch, and an anvil portion 42 for bending the binding needle hit into the sheet bunch. The binding processing section 40 is disposed so that the head portion 41 and the anvil portion 42 are disposed to be opposed with the storage section H1 sandwiched therebetween above the folding processing section 30. More specifically, the head portion 41 is disposed on the sheet discharge tray 60 side, while being opposed to the conveyance path of the conveyance section 13, and the anvil portion 42 is disposed on the side opposite to the head portion 41 with the conveyance path therebetween.

Needle storage sections 43 for supplying the binding needle to the binding section 40 are arranged on the side opposite to the conveyance path of the head portion 41. Then, on the sheet discharge tray 60 side of the needle storage section 43 is provided and defined a space region (in this application, referred to as "access space" as appropriate) opened in an operation direction when a user performs operation for refilling the binding section 40 with the binding needle, removing or attaching the needle storage section 43 and the like. Herein, the access space is usable space for the user to not only refill the needle storage section 43 with the binding needle, but also remove or attach the needle storage section 43 from/to the binding section 40, and is provided so that any obstruction for interfering with the operation does not exist.

The folding processing section 30 performs the folding processing for folding the sheet P in two or three. Therefore, as shown in FIG. 2B, in addition to the first stopper 31A described above, the folding processing section 30 is comprised of a first sheet folding plate (sheet folding section) 32, first roller 33, second roller 34, third roller 35, conveyance path switch member 36, receiving section H10 formed from guide plates 37, and second sheet folding plate (sheet folding section) 38. In this Embodiment, the first roller 33 and second roller 34 constitute the first folding roller pair, and the second roller 34 and third roller 35 constitute the second folding roller pair. In other words, the second roller 34 is shared between the first folding roller pair and the second folding roller pair, and in another Embodiment, in the first folding roller pair and the second folding roller pair, rollers supporting the first roller 33 and third roller 35 are capable of being comprised of respective different rollers.

In the first roller 33 and second roller 34 constituting the first folding roller pair, their roller faces are brought into press-contact with each other by spring members not shown in the figure. Since each of the roller faces of the first roller 33 and second roller 34 has high frictional resistance, when at least one of the first and second rollers 33, 34 is driven to rotate, the other roller also rotates.

Similarly, in the second roller 34 and third roller 35 constituting the second folding roller pair, their roller faces are brought into press-contact with each other by spring members not shown in the figure. Since each of the roller faces of the second roller 34 and third roller 35 has high frictional resistance, when at least one of the second and third rollers 34, 35 is driven to rotate, the other roller also rotates.

The first sheet folding plate 32 is provided in a position opposed to a nip portion of the first roller 33 and second roller 34 of the first folding roller pair with the storage section H1 therebetween to be able to enter and retract with respect to the storage section H1 in a direction orthogonal to the sheet conveyance direction. Ordinarily, in order not to interfere with a shift of the sheet P conveyed in the storage section H1, the sheet folding plate 32 is disposed in a position retracted from the storage section H1.

In the case of forming the first fold in a predetermined position of the sheet P which is position-regulated by the first stopper 31A in the sheet conveyance direction and exists inside the storage section H1, the sheet folding plate 32 protrudes toward the nip portion of the first roller 33 and second roller 34 by a drive source not shown in the figure. By this means, the predetermined position of the sheet P inside the storage section H1 is guided to the nip portion of the first roller 33 and second roller 34, and is nipped by rotation of the first folding roller pair, and the first fold is formed in the sheet P.

The receiving section H10 is provided at an approximately right angle i.e. approximately vertically upward with respect to a straight line joining a rotation center of the first roller 33 and a rotation center of the second roller 34. The receiving section H10 is formed from a pair of first and second receiving guide members each comprised of the guide plate 37. In the first and second receiving guide members, one is positioned on the storage section H1 side, while the other one is positioned on the sheet discharge tray 60 side, and the members are disposed to be opposed so as to define a path for contacting the sheet fed out of the first folding roller pair to therebetween to guide and store.

As shown in FIG. 2B, an intermediate conveyance path H2 is formed between the nip portion of the first folding roller pair and the receiving section H10. The conveyance path switch member 36 is provided to be able to swing by a drive source not shown in the figure, and is an allocating section for switching the conveyance direction of the sheet fed into the intermediate conveyance path H2 by the first folding roller pair to allocate. In this Embodiment, in the case of performing three-fold processing on the sheet P, the conveyance path switch member 36 is in a position shown in FIG. 3, and guides the sheet P fed out of the first folding roller pair to the receiving section H10.

The sheet P is conveyed and stored inside the receiving section H10 with the first fold being the front end, and is temporarily held. Since the receiving section H10 is provided substantially vertically upward, the sheet P conveyed into the path tends to generate distortion by its own weight corresponding to its stiffness.

The second sheet folding plate 38 is provided in a position (i.e., upper position of the intermediate conveyance path H2) opposed to a nip portion of the second roller 34 and third roller 35 of the second folding roller pair with the intermediate conveyance path H2 therebetween to be able to enter and retract with respect to the intermediate conveyance path in a direction orthogonal to the sheet conveyance direction of the path H2. Ordinarily, in order not to interfere with a shift of the sheet P conveyed in the intermediate conveyance path H2, the second sheet folding plate 38 is disposed in a position retracted from the intermediate transport path H2.

A formation position of a second fold formed in the sheet P with the first fold formed by the first folding roller pair is determined by a sheet conveyance amount of the first folding roller pair for regulating a front end position (i.e. upper end position) of the sheet fed into the receiving section H10. In the case of forming the second fold in thus determined predetermined position of the sheet P, the second sheet folding plate 38 is protruded toward the nip portion of the second roller 34 and the third roller 35 by a drive source not shown in the figure.

Figure 4:
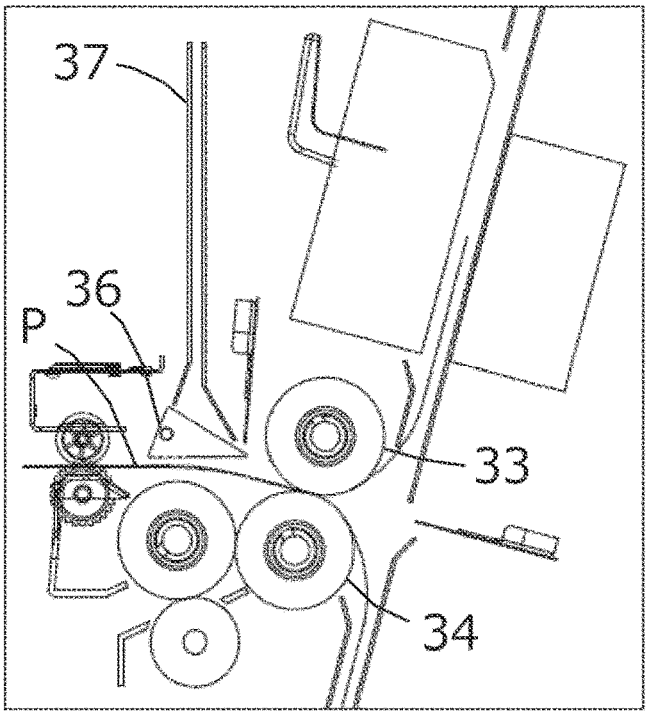
FIG. 4 is an explanatory view illustrating operation of the folding processing section for folding a sheet in two.

By this means, as shown in FIG. 4, the predetermined position of the sheet P is guided to the nip portion of the second roller 34 and the third roller 35, and is nipped by rotation of the second folding roller pair, and the second fold is formed in the sheet P. By the second folding roller pair further rotating, the sheet P thus undergoing the three-fold processing is fed to a lower conveyance path H12 below the pair, and is discharged to the sheet discharge tray 60 that is a sheet receiving section from a lower discharge opening E2.

The receiving section H10 extends to a height position crossing the access space to access the needle storage section 43. By this means, even when the sheet P is a large sheet size exceeding the length of 297 mm, without upsizing the sheet binding folding processing section 20 and sheet post-processing apparatus 10, it is possible to perform the three-fold processing.

Figure 3:
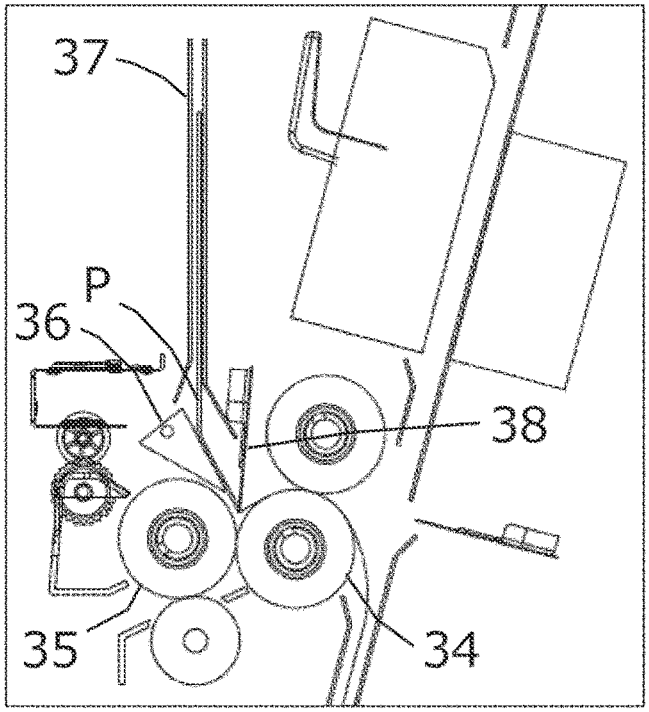
FIG. 3 is an explanatory view illustrating operation of a folding processing section for folding a sheet in three.

In the case of performing two-fold (i.e. middle-fold) processing on the sheet P, the conveyance path switch member 36 swings from the position shown in FIG. 3 counterclockwise in the figure, and shifts to a position shown in FIG. 4. By this means, the sheet P with the first fold formed by the first folding roller pair is fed to an upper conveyance path H11 (FIG. 2B) provided to be continued to the intermediate conveyance path H2 in substantially the same height and substantially same direction from the first folding roller pair via the intermediate conveyance path H2. Further, the sheet P conveyed to an upper discharge opening E1 is discharged to the sheet discharge tray 60 of the sheet receiving section by a discharge section 50.

The sheet P in this Embodiment includes not only a single sheet but also a sheet bunch comprised of a plurality of sheets subjected to the binding processing by the binding processing section 40. In this case, performing the two-fold processing on the sheet P means performing middle-fold processing on a saddle-stitched sheet bunch. In other words, the sheet P that is a sheet bunch collected in the storage section H1 is subjected to the binding processing in its predetermined saddle stitch position by the binding processing section 40, and then, is subjected to middle-fold processing in the saddle stitch position by the first folding roller pair. Subsequently, the sheet P is conveyed in the intermediate conveyance path H2 and upper conveyance path H11, and is discharged to the sheet discharge tray 60 by the discharge section 50.

[Control Section]

Figure 5:
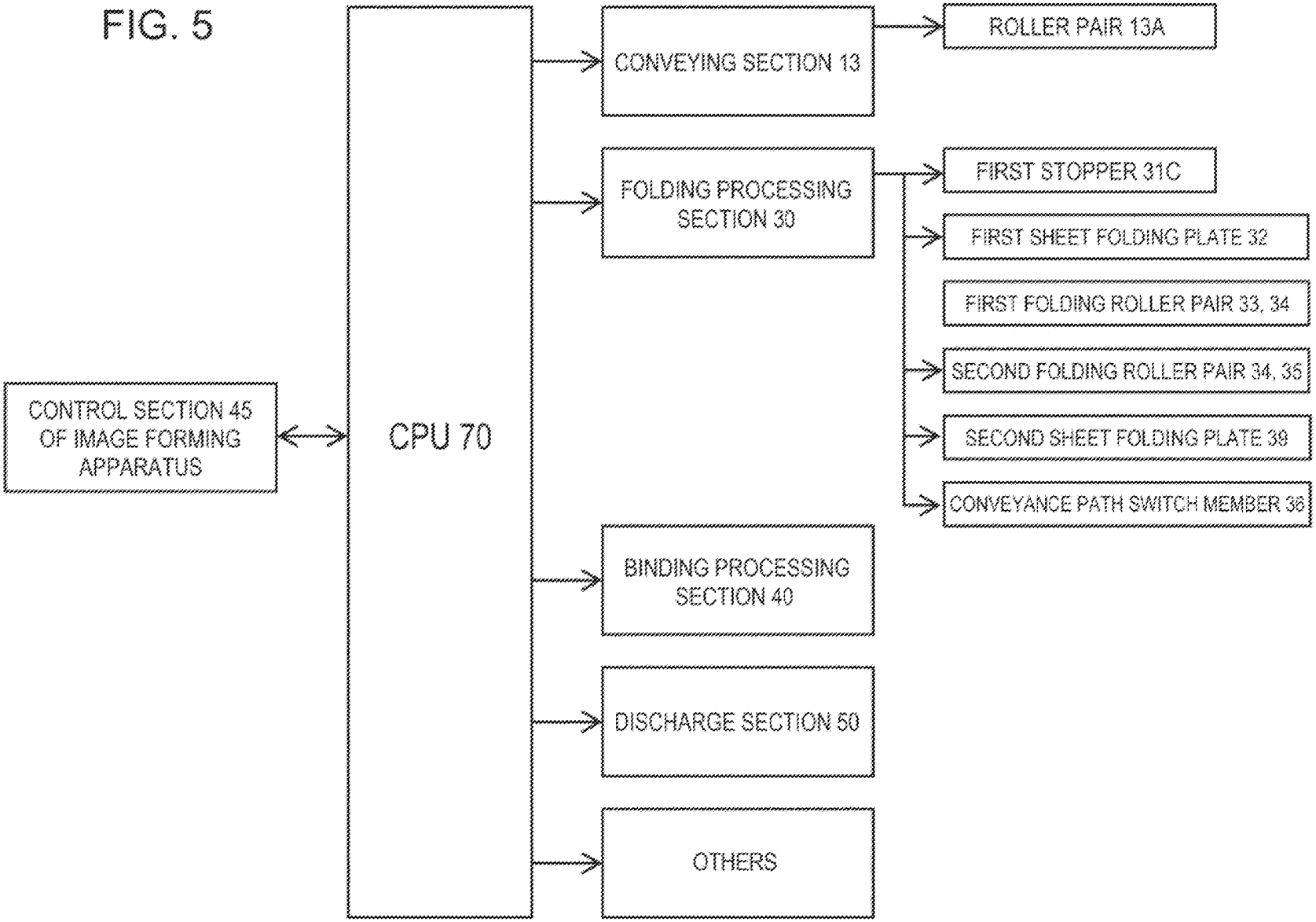
FIG. 5 is a block diagram illustrating a control configuration of the sheet post-processing apparatus.

FIG. 5 illustrates a configuration of a control section of the sheet post-processing apparatus 10. As shown in the figure, the control section is comprised of a CPU 70 for controlling operation of the folding processing section 30, binding processing section 40 and discharge section 50. The CPU 70 also controls operation of other processing mechanisms, various conveyance rollers and so on not shown in the figure of the sheet post-processing apparatus 10. To the CPU 70 are input detection signals from other sensors and the like not shown in the figure. Further, the CPU 70 is connected to a control section 45 of the image forming apparatus connected to the sheet post-processing apparatus 10 to be in conjunction therewith, and to the CPU 70 is input a post-processing mode such as a three-fold mode selected by the user on the image forming apparatus side.

[Folding Processing]

Next, referring to FIGS. 6A to 7E, descriptions will be given to the folding processing in the folding processing section 30. FIGS. 6A to 6D illustrate operation of the folding processing section 30 in order of process step in the case of performing the two-fold processing on the sheet P.

Figure 6A:
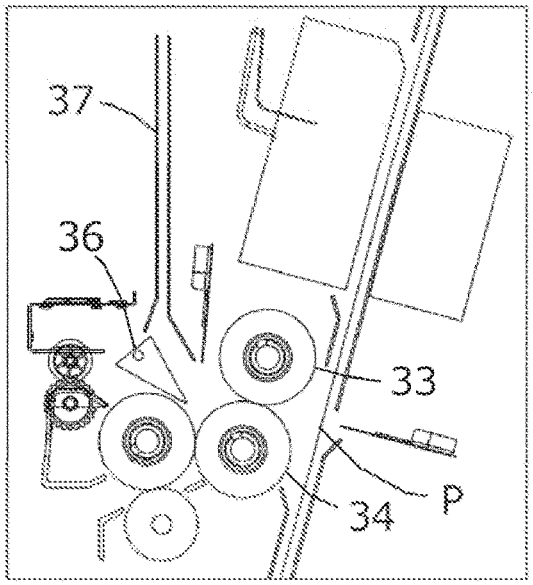
FIGS. 6A to 6D are views illustrating two-fold operation of the sheet binding folding processing section in order of process step.
Figure 6B:
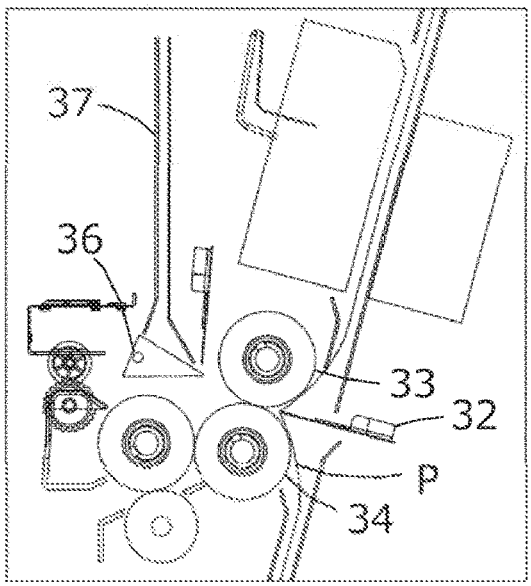
Figure 6C:
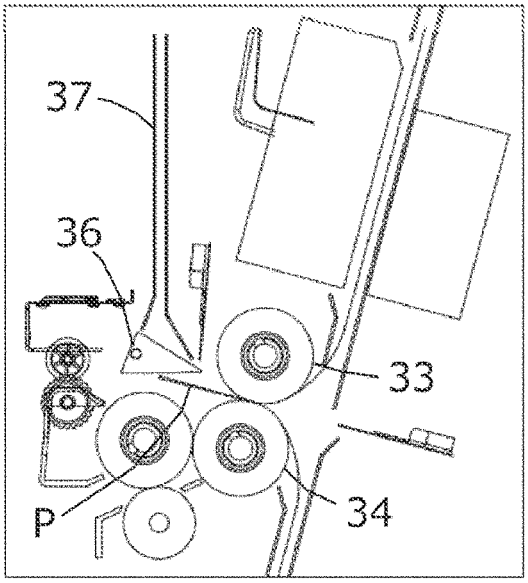
Figure 6D:
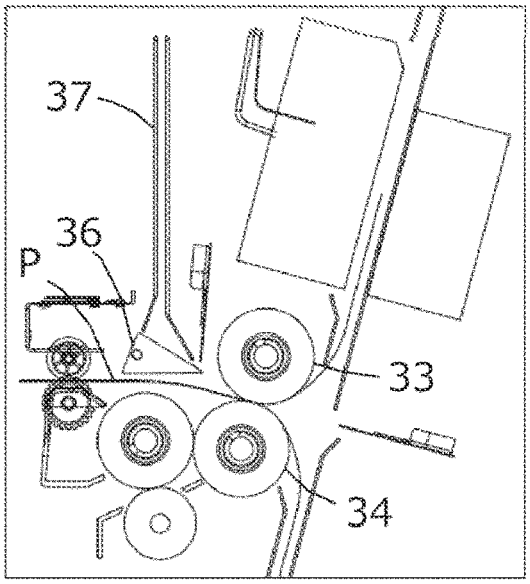

First, the printed sheet P output from the image forming apparatus is collected in the storage section H1 (FIG. 6A). The sheet P is subjected to positioning in the sheet conveyance direction by the first stopper 31A (shown in FIG. 2B) inside the storage section H1. When sheets P collected in the storage section H1 reach the predetermined number of sheets, the first roller 33 and second roller 34 rotate in a direction for feeding the sheet to the intermediate conveyance path H2, while the first sheet folding plate 32 protrudes from the position retracted from the storage section H1 toward the nip portion of the first roller 33 and the second roller 34 (FIG. 6B). By this means, in the sheet P, the predetermined position in the sheet conveyance direction is pushed into the nip portion of the first roller 33 and the second roller 34, the sheet is nipped between the first roller 33 and the second roller 34, and is conveyed to the intermediate conveyance path H2, and the first fold is thereby formed (FIG. 6C).

At the time the sheet P is nipped by the first roller 33 and second roller 34, the first sheet folding plate 32 shifts in an opposite direction that is a direction for separating from the nip portion of the first and second rollers 33, 34, and returns to the position retracted from the storage section H1. On the other hand, the conveyance path switch member 36 swings counterclockwise from the position shown in FIG. 3, and shifts to the position shown in FIG. 4. By this means, the sheet P folded in two by the first and second rollers 33, 34 is prevented from entering the receiving section H10, is guided from the intermediate conveyance path H2 to the upper conveyance path H11 (FIG. 6D), and is discharged to the sheet discharge tray 60.

Figure 7A:
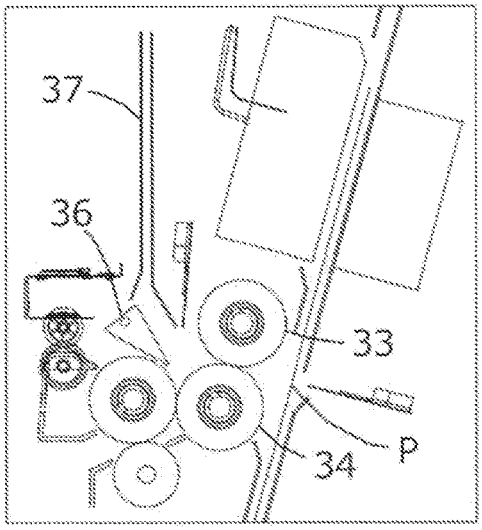
FIGS. 7A to 7E are views illustrating three-fold operation of the sheet binding folding processing section in order of process step.
Figure 7B:
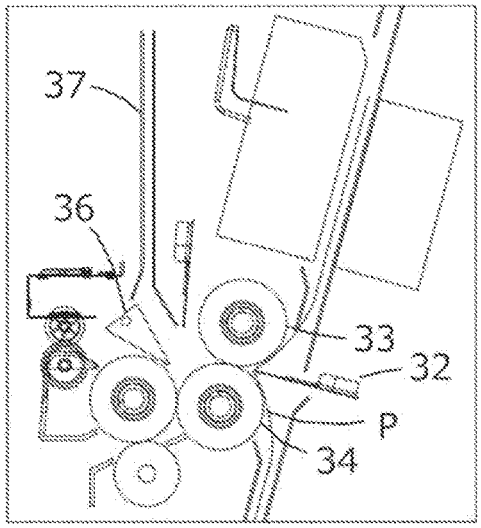
Figure 7C:
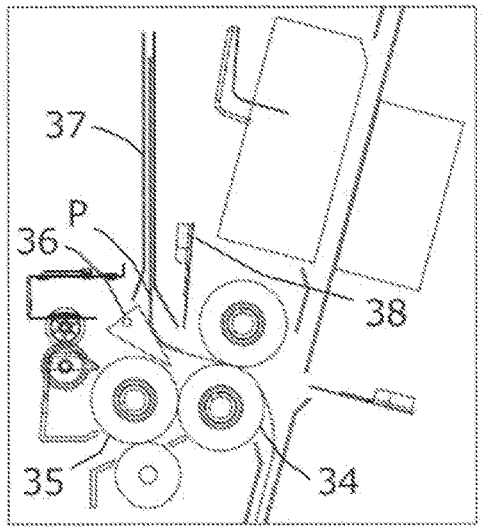
Figure 7D:
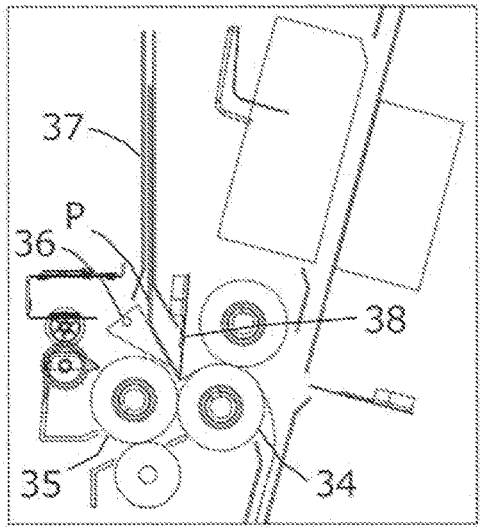

FIGS. 7A to 7E illustrate operation of the folding processing section 30 in order of process step in the case of performing the three-fold processing on the sheet P. As in the case of the above-mentioned two-fold processing, the printed sheet P output from the image forming apparatus is collected in the storage section H1 (FIG. 7A), and is subjected to positioning in the sheet conveyance direction by the first stopper 31A (shown in FIG. 2B). When sheets P collected in the storage section H1 reach the predetermined number of sheets, the first roller 33 and second roller 34 rotate in the direction for conveying the sheet to the intermediate conveyance path H2, while the first sheet folding plate 32 protrudes from the position retracted from the storage section H1 toward the nip portion of the first roller 33 and the second roller 34 (FIG. 7B). By this means, in the sheet P, a predetermined position in the sheet conveyance direction is pushed into the nip portion of the first roller 33 and second roller 34, the sheet is nipped between the first roller 33 and the second roller 34, and is conveyed to the intermediate conveyance path H2, and the first fold is thereby formed (FIG. 7C).

At this point, as shown in FIG. 7C, the conveyance path switch member 36 is disposed in a position for preventing the sheet P from entering the upper conveyance path H11 from the intermediate conveyance path H2, and allowing the sheet P to enter the receiving section H10. By this means, the sheet P fed out of the nip portion of the first and second rollers 33, 34 is conveyed into the receiving section H10 from the intermediate conveyance path H2, and is temporarily held.

The position of the first fold of the sheet P conveyed to the receiving section H10 is determined by a conveyance amount of the sheet P by the first folding roller pair. The receiving section H10 is comprised of the pair of opposed first and second receiving guide members 37, in addition thereto, is provided in a position in which its upper end is sufficiently high upward by crossing the access space to the needle storage section 43, and therefore, also in the case of folding the sheet of the size larger than the A4 size, is capable of stably receiving the first fold into the receiving section 10.

As described above, the receiving section H10 is formed so as to extend upward at the substantially right angle from a straight line orthogonal to the straight line joining the rotation center of the first roller 33 and the rotation center of the second roller 34, and therefore, the sheet P inside the receiving section H10 tends to distort on the lower side. The sheet P with the lower side distorted inside the receiving section H10 is pushed downward inside the intermediate conveyance path H2, when the second sheet folding plate 38 protrudes from the retract position above the intermediate conveyance path H2 toward the nip portion of the second roller 34 and third roller 35, and the distortion is thereby canceled.

Figure 7E:
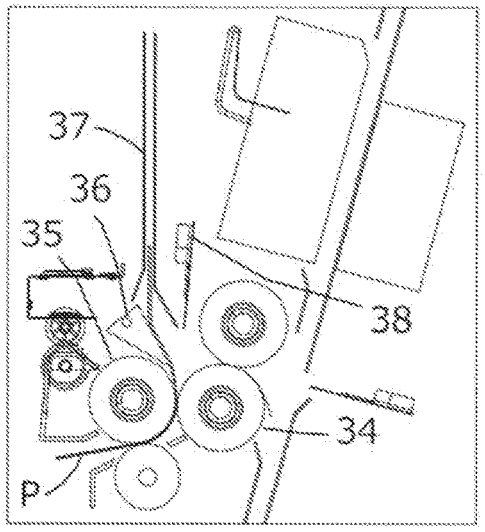

By further protruding the second sheet folding plate 38, the predetermined position of the sheet P enters the nip portion of the second and third rollers 34, 35, and is nipped, and the second fold is formed (FIG. 7E). The sheet P with the second fold formed is fed to the lower conveyance path H12 below, by the second and third rollers 34, 35 further rotating, and is discharged to the sheet discharge tray 60 that is the sheet receiving section from the lower discharge opening E2.

In this Embodiment, as described above, the receiving section H10 extends to the height position crossing the access space to access the needle storage section 43, and is thereby capable of receiving also sheets of sheet sizes exceeding the A4 size i.e. the length of 297 mm. By this means, for not only conventional sheets up to the A4 size but also sheets larger than the A4 size, it is possible to perform the three-fold processing, without increasing dimensions of the sheet binding folding processing section 20 and sheet post-processing apparatus 10 from conventional dimensions.

In response to that the sheet binding folding processing section 20 is capable of shifting between the operating position inside the main body 11 and the maintenance position outside, it is preferable that the receiving section H10 is disposed to be able to receive the sheet which is subjected to the folding processing by the first folding roller pair and is conveyed, when the sheet binding folding processing section 20 is in the operating section, while releasing crossing the access space to enable the needle storage section 43 to be accessed, when the sheet binding folding processing 20 is pulled outside the main body 11 and is in the maintenance position. By this means, it is possible to readily perform operation for refilling the needle storage section 43 with binding needles, without the receiving section H10 interfering.

Figure 8B:
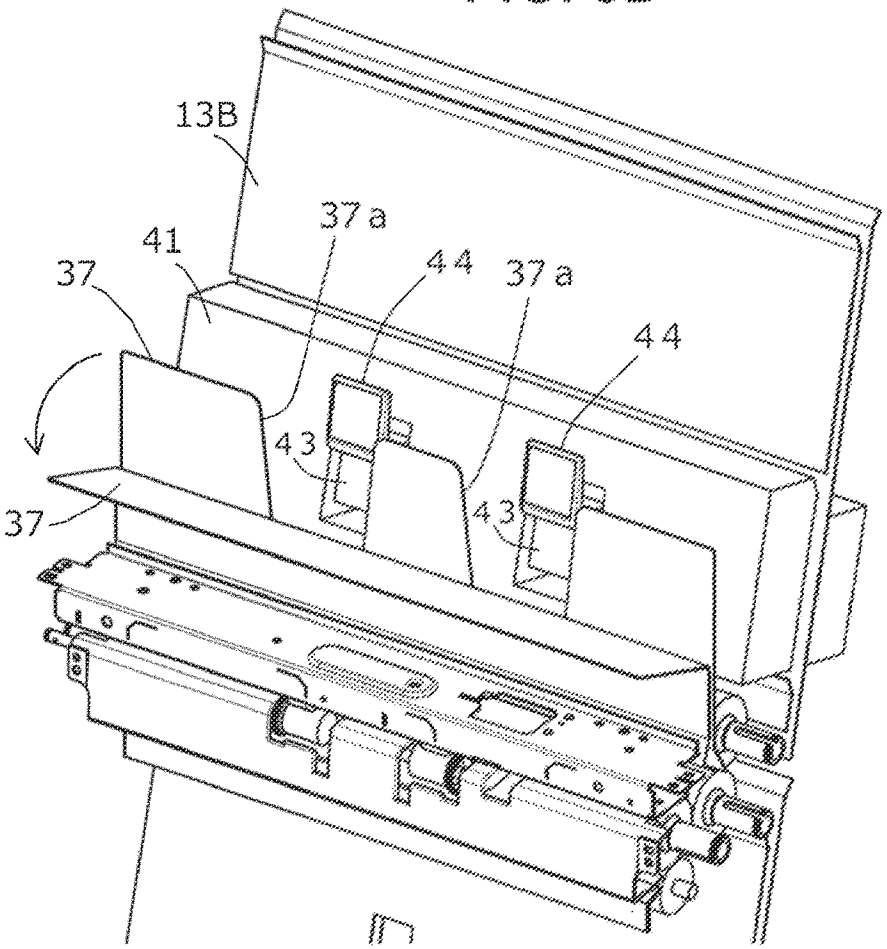
FIGS. 8A and 8B are explanatory views illustrating a configuration capable of shifting between a guide position and a retract position of a receiving section.
Figure 8A:
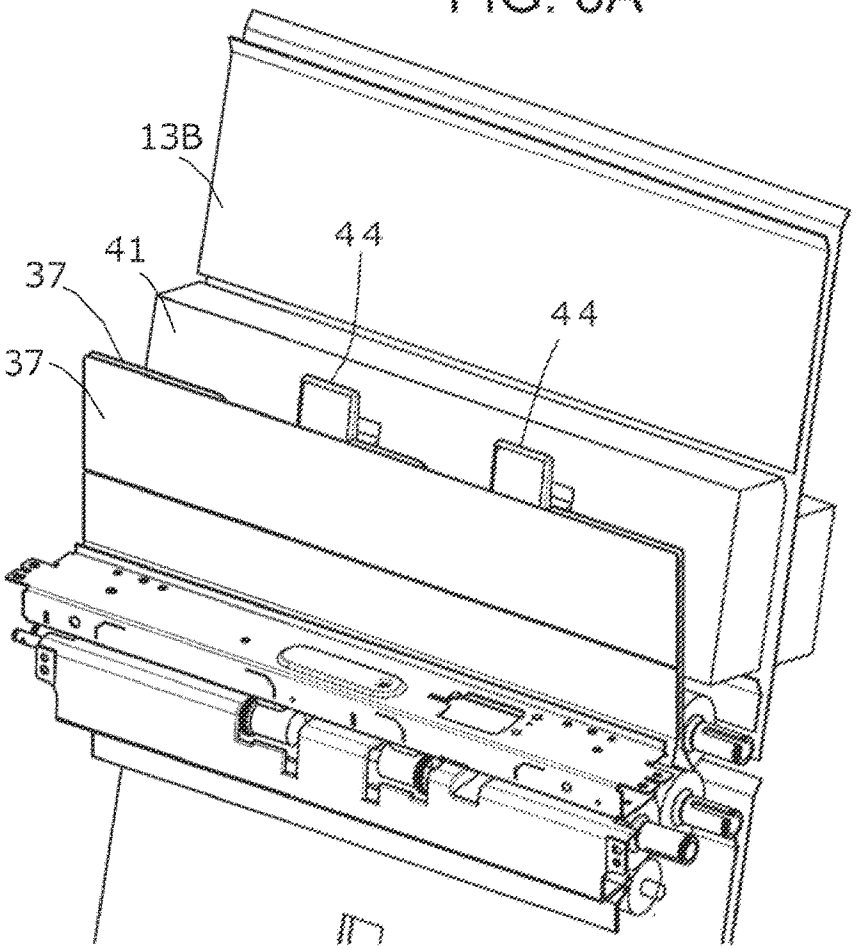

FIGS. 8A and 8B illustrate a suitable Embodiment of the receiving section H10 which is thus able to stably receive the sheet with the first fold formed without being dependent on the sheet size in the operating position, and is able to ensure the access to the needle storage section 43 in the maintenance position. FIG. 8A illustrates the receiving section H10 (sheet binding folding section 20) existing in the operating position, and FIG. 8B illustrates the section H10 existing in the maintenance position.

As described above, the receiving section H10 of this Embodiment is comprised of a pair of first and second receiving guide members (guide plates) 37 disposed to be opposed so as to define the path for guiding and storing the sheet fed out of the first folding roller pair. As shown in FIG. 8B, in the first receiving guide member 37 disposed on the storage section H11 side with the path therebetween are formed substantially rectangular notch portions 37*a* to open the access space toward the outside. The second receiving guide member 37 disposed on the side opposite to the storage section H1s with the path therebetween is provided to be able to rotate between a guide position of FIG. 8A crossing the access space so as to define the path and a retract position of FIG. 8B to open the access space. By thus configuring a pair of first and second receiving guide members 37, it is possible to concurrently actualize stable reception of the sheet P in the guide position and access reservation to the needle storage section 43 in the retract position.

Figure 9B:
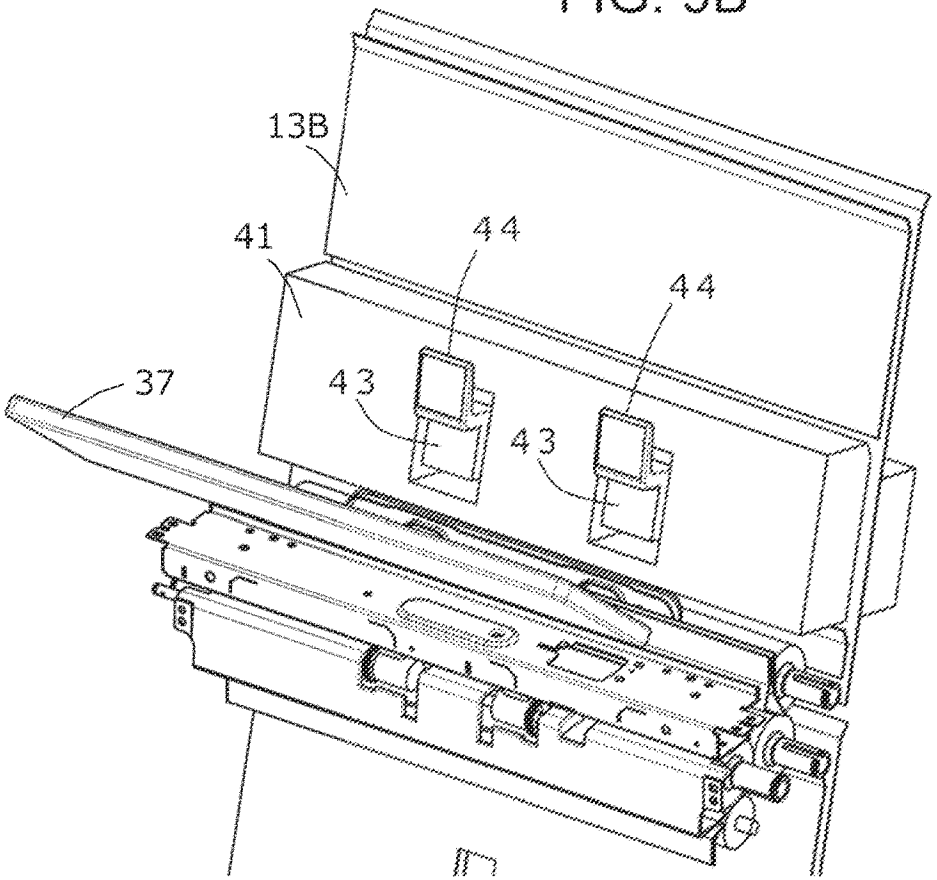
FIGS. 9A and 9B are explanatory views illustrating Modification 1 of the receiving section.
Figure 9A:
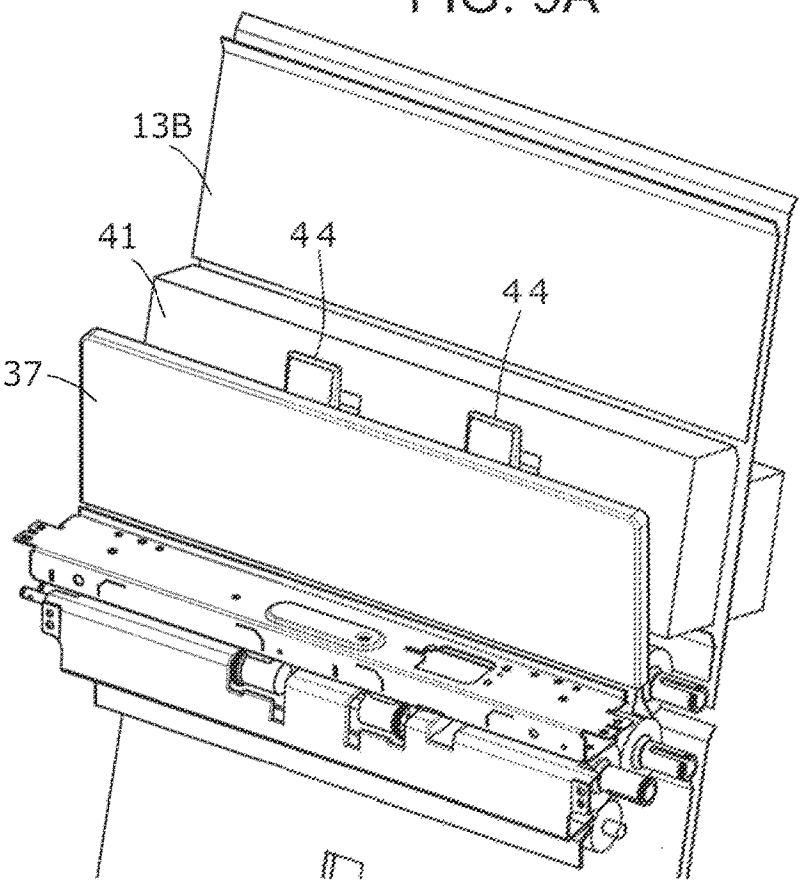

FIGS. 9A and 9B illustrate Modification 1 of the receiving section H10 of FIGS. 8A and 8B. The receiving section H10 of the Modification 1 differs from the Embodiment in FIGS. 8A and 8B in the respect that a pair of first and second receiving guide members (guide plates) 37 disposed to be opposed so as to define the path for contacting the sheet fed out of the first folding roller pair to guide and store is configured to be integrally (or individually) detachable/attachable from/to the sheet binding folding processing section 20. In this case, it is not necessary to provide the notch portion 37*a* of FIG. 8B in any of the first and second receiving guide members 37.

Figure 10:
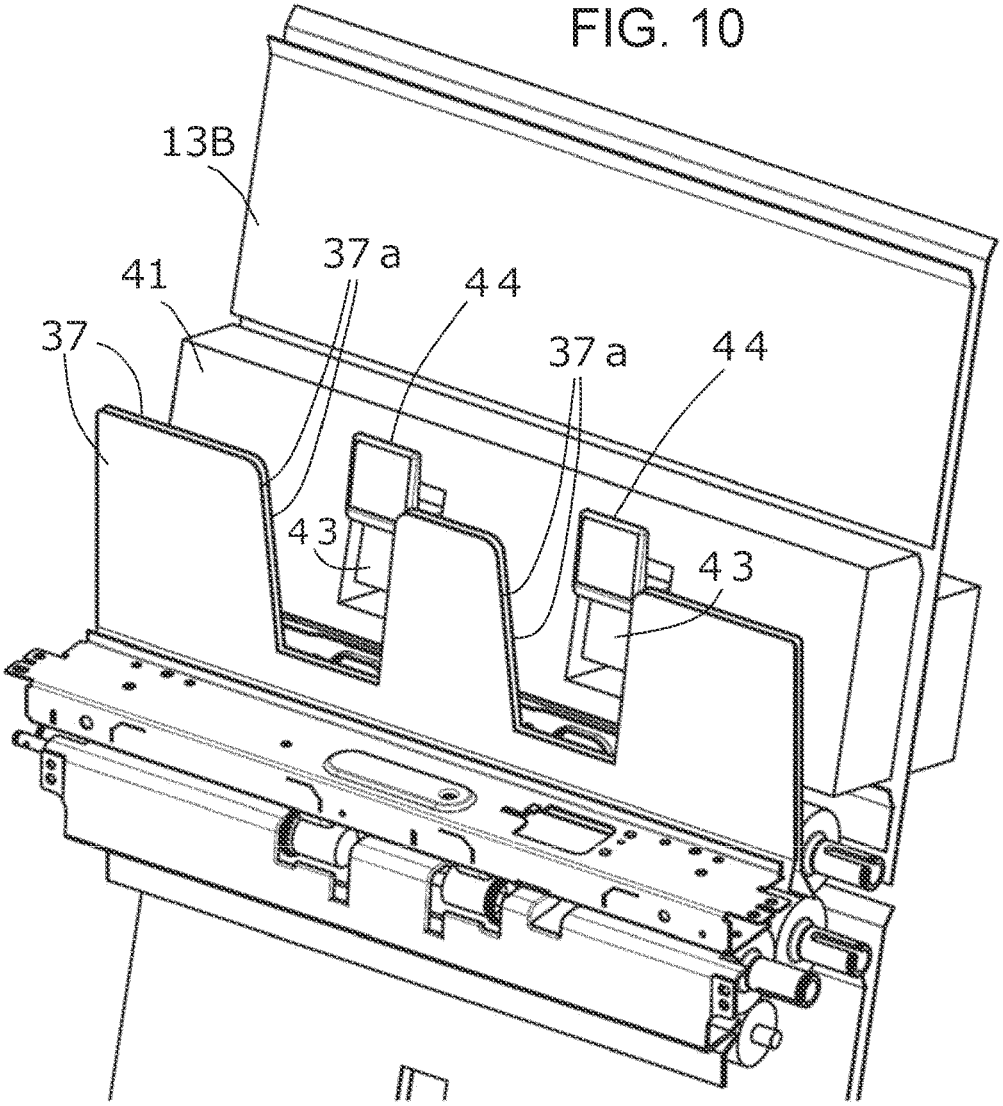
FIG. 10 is an explanatory view illustrating Modification 2 of the receiving section.

FIG. 10 illustrates Modification 2 of the receiving section H10 of FIGS. 8A and 8B. The receiving section H10 of the Modification 2 differs from each of above-mentioned Embodiments in the respect that the notch portions 37*a* of FIG. 8B are provided in both of a pair of first and second receiving guide members (guide plates) 37 disposed to be opposed so as to define the path for contacting the sheet fed out of the first folding roller pair to guide and store. The notch portions 37*a* of the first and second receiving guide members 37 are provided in mutually corresponding positions. By this means, the need is eliminated for operation to open the access space in the maintenance position.

Figure 11:
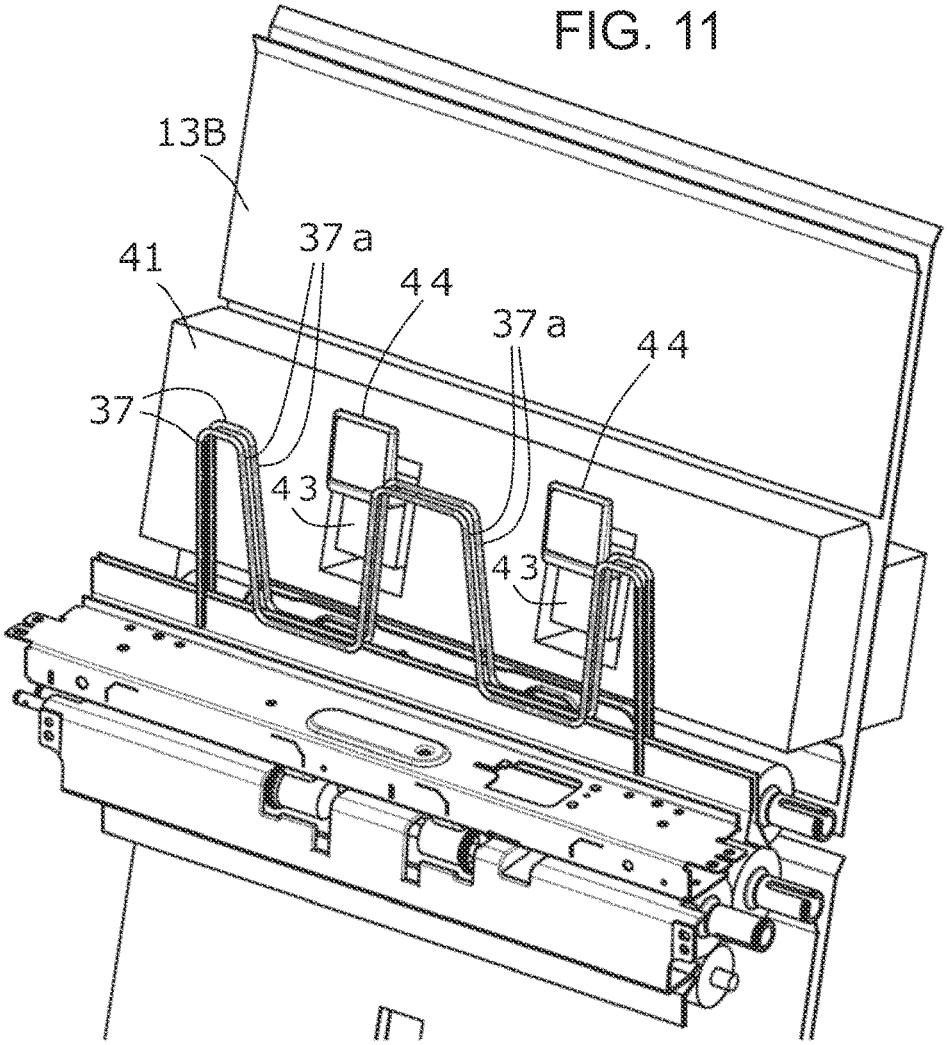
FIG. 11 is an explanatory view illustrating Modification 3 of the receiving section.

FIG. 11 illustrates Modification 3 of the receiving section H10 of FIGS. 8A and 8B. The receiving section H10 of the Modification 3 differs from each of above-mentioned Embodiments in the respect that the section H10 is formed from a pair of frame members 37 each obtained by tracing an outer portion of the guide plate 37 having the notch portion 37*a* of FIG. 10. In the frame member 37, frame portions for defining frame portions in opposite right and left ends and the notch portions 37A are provided over the substantially entire length in the height direction of the receiving section H10 i.e. in the receiving direction of the sheet, and therefore, the section 10 is capable of stably receiving the sheet with the first fold formed.

Figure 12A:
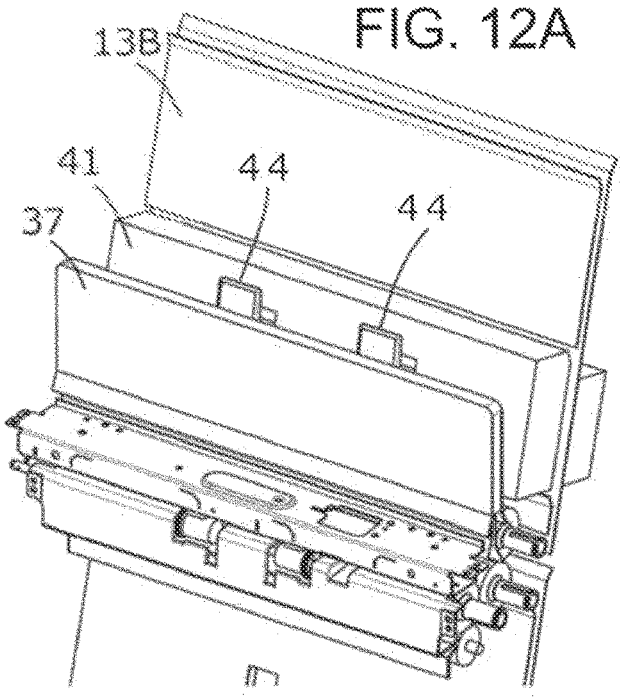
FIGS. 12A and 12B are explanatory views illustrating Modification 4 where the receiving section is held in an operating position also in maintenance.
Figure 12B:
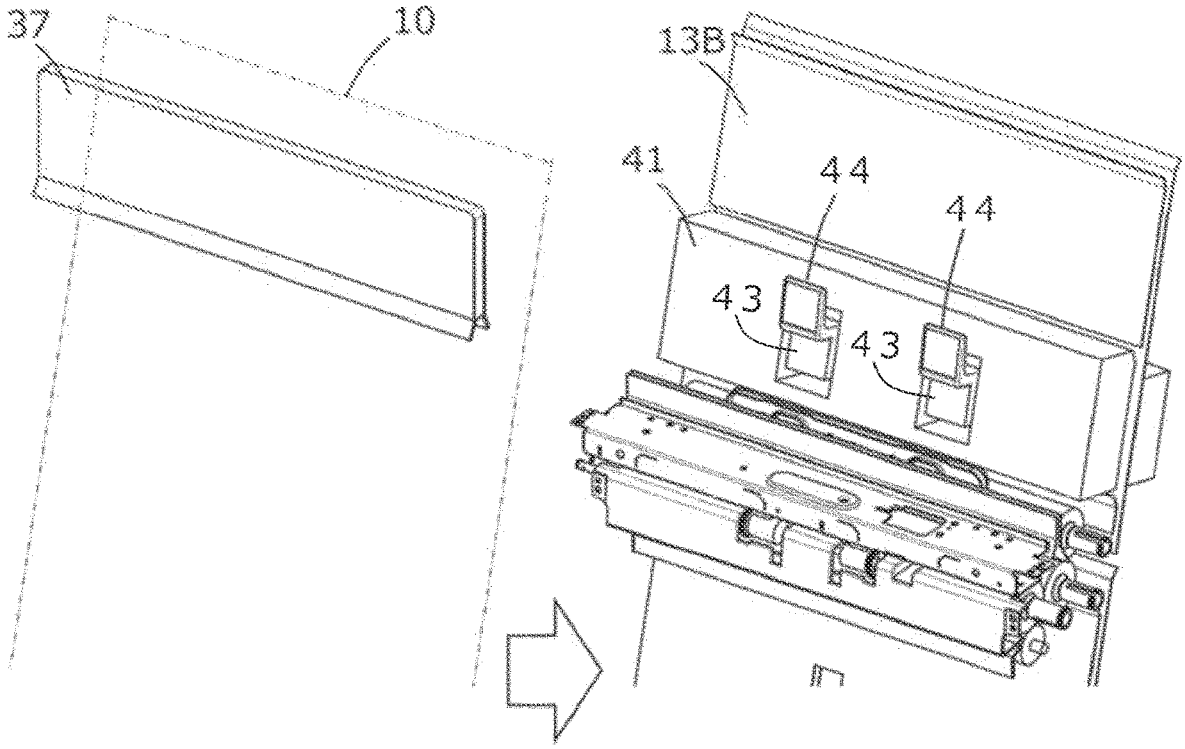

FIGS. 12A and 12B illustrate Modification 4 of the receiving section H10 of FIGS. 8A and 8B. FIG. 12A illustrates the section when the sheet binding folding processing section 20 exists in the operating position, and FIG. 12B illustrates the section when the sheet binding folding processing section 20 exists in the maintenance position. The receiving section H10 of the Modification 4 differs from each of above-mentioned Embodiments in the respect that the section H10 is configured to remain in a predetermined position inside the main body 11 as illustrated in FIG. 12B (left side in FIG. 12B) when the sheet binding folding processing section 20 is pulled from the main body 11 and shifts to the maintenance position (right side in FIG. 12B). The Modification 4 eliminates the needs to form the notch portion in the receiving section H10 or to perform operation to open the access space, and has an advantage.

Previously, it is described that the access space is provided so as to define the space portion opened in the direction for performing operation, in performing the operation for adding binding needles to the binding section 40, removing or attaching the needle storage section 43, and the like. Herein, further, the operation for removing or attaching the needle storage section 43 with respect to the binding section 40 will be described in detail with reference to FIGS. 13 to 15.

Figure 13:
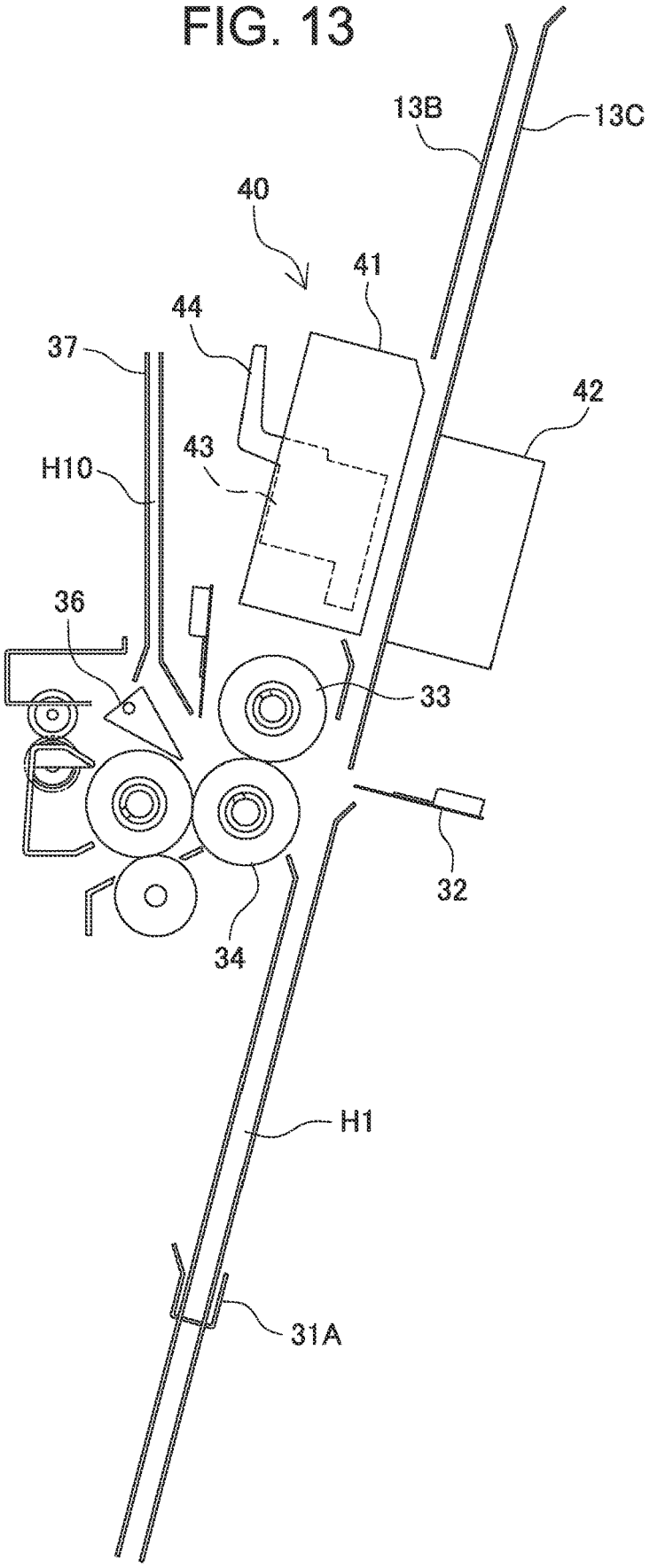
FIG. 13 is a principal configuration view of the sheet binding folding processing section.

FIG. 13 illustrates the principal configuration of the sheet binding folding processing section 20 for applying the folding processing and binding processing to the sheet P described in FIGS. 2A and 2B. Dashed lines inside the head portion 41 of the binding section 40 indicate a contour of the outside shape of the needle storage section 43 for storing sheet-shaped staples. The needle storage section 43 is a cartridge-shape container indicated by the dashed line in FIG. 13, and is configured to be attachable and detachable to/from the head portion 41.

Figure 14:
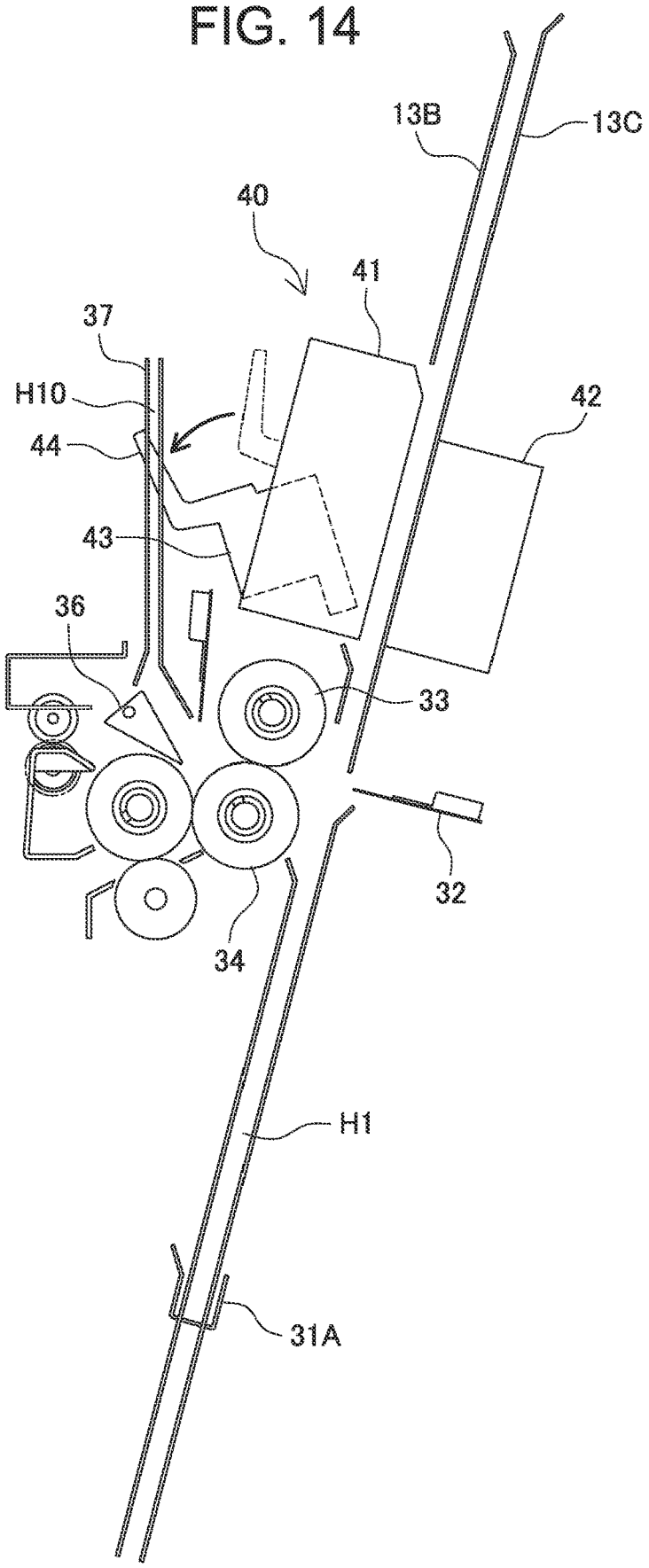
FIG. 14 is a view illustrating a state during removal of a cartridge-shaped needle storage section in FIG. 13 from a head portion.

FIG. 14 illustrates a state during which the cartridge-shaped needle storage section 43 described in FIG. 13 is removed from the head portion 41. The needle storage section 43 is provided with a lever portion 44 protruding from the cartridge-shaped container upward as viewed in FIG. 14. The user puts fingers on the lever portion 44, pulls the lever portion 44 to the front side viewed from the side on which the sheet of the sheet post-processing apparatus 10 is discharged, and is thereby capable of removing the needle storage section 43 from the head portion 41. With a corner of the needle storage section 43 positioned on the diagonal line with the front end of the lever portion 44 as a fulcrum as shown in FIG. 14, the needle storage section 43 is removed from the head portion 41, while rotating in a counterclockwise direction shown in the figure.

When the needle storage section 43 is removed from the head portion 41, a locus of the needle storage section 43 being removed crosses the receiving section H10 as shown in FIG. 14. In other words, the receiving section H10 is disposed so that the locus of the needle storage section 43 being removed from the binding section 40 crosses a locus of the sheet received in the receiving section H10 shifting. The receiving section H10 is disposed so that the locus of the needle storage section 43 being removed from the binding section 40 crosses the locus of the sheet received in the receiving section H10 shifting, and the notch portion 37*a* in each Embodiment described previously is formed. Therefore, the receiving section H10 does not interfere with the locus of the needle storage section 43 being removed from the binding section 40, and it is possible to remove the needle storage section 43.

Figure 15:
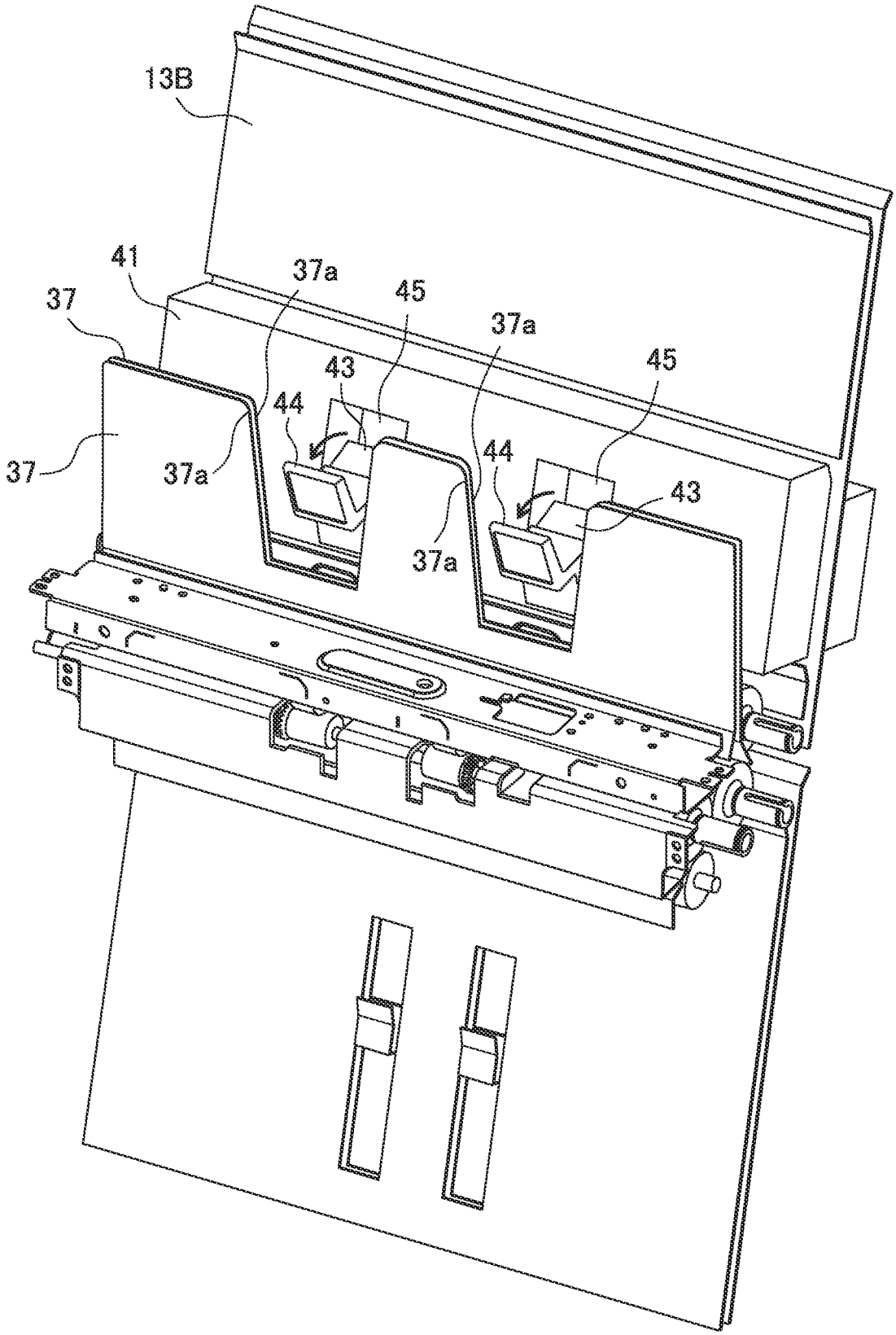
FIG. 15 is a view illustrating a state during removal of the cartridge-shaped needle storage section in FIG. 10 from the head portion.

FIG. 15 illustrates a state during which the cartridge-shaped needle storage section 43 is removed from the head portion 41 described in FIG. 13, in the Modification 2 described with reference to FIG. 10. The head portion 41 is provided with concave portions 45 to attach the needle storage section 43. The concave portion 45 provided in the head portion 41 is defined to the extent slightly larger the outside shape of the needle storage section 43 so as to regulate an attachment position of the needle storage section 43 to the head portion 41 in the sheet width direction.

Therefore, in removing the needle storage section 43 from the head portion 41, movement in the sheet width direction is regulated by the concave portion 45 of the head portion 41. Accordingly, as described previously, looking from the side for discharging the sheet of the post-processing apparatus 10, by pulling the lever portion 40 to the front side, it is possible to remove the needle storage section 43 from the head portion 41. The receiving section H10 is disposed so that the locus of the needle storage section 43 being removed from the binding section 40 crosses the locus of the sheet received in the receiving section H10 shifting. However, since the notch portion 37*a* in each Embodiment described previously is formed, the receiving section H10 does not interfere with the locus of the needle storage section 43 being removed from the binding section 40, and it is possible to remove the needle storage section 43.

As described above, suitable Embodiments of the present invention are described, but the present invention is not limited to the Embodiments, and allows appropriate modifications to be made within the scope of not departing from the technical scope of the invention.

The invention claimed is:

1. A sheet post-processing apparatus comprising:

a conveying section adapted to convey a sheet in a predetermined conveyance direction;

a storage section adapted to store sheets conveyed by the conveying section;

a binding section adapted to apply binding processing using a binding needle to a sheet bunch formed from a plurality of sheets stored in the storage section;

a needle storage section detachably attached to the binding section to store the binding needle supplied to the binding section;

a first folding roller pair adapted to nip a sheet or the sheet bunch stored in the storage section in a predetermined first position in the conveyance direction, and thereby form a first fold portion in the first position;

a receiving section adapted to receive the sheet or the sheet bunch with the first fold portion formed by the first folding roller pair; and a second folding roller pair adapted to nip the sheet or the sheet bunch with the first fold portion formed inside the receiving section in a second position different from the first position, and thereby form a second fold portion in the second position, wherein the first folding roller pair and the second folding roller pair are disposed on a same side as the needle storage section attached to the binding section with respect to the storage section, below the needle storage section, in a thickness direction of the sheet or the sheet bunch stored in the storage section, and the receiving section is disposed above the first folding roller pair and the second folding roller pair so as to sandwich the needle storage section between the storage section and the receiving section, in a position crossing a locus of the needle storage section being removed from the binding section to add the binding needle.

2. The sheet post-processing apparatus according to claim 1, further comprising:

a processing unit adapted to store the conveying section, the storage section, the binding section, the needle storage section, the first folding roller pair, the second folding roller pair, and the receiving section, wherein the processing unit is able to shift between an inside position positioned inside the sheet post-processing apparatus and an outside position positioned outside the sheet post-processing apparatus, and a portion of the receiving section crossing the locus of the needle storage section being removed from the binding section is configured to be able to open outside the sheet post-processing apparatus when the processing unit is in the outside position.

3. The sheet post-processing apparatus according to claim 2, wherein the receiving section includes a pair of first and second receiving guide members opposed so as to define a path for contacting the sheet or the sheet bunch fed out of the first folding roller pair to guide, the first receiving guide member positioned on the storage section side of the path includes a notch portion in the portion crossing the locus of the needle storage section being removed from the binding section, and when the processing unit is in the outside position, the second receiving guide member positioned on a side opposite to the first receiving guide member with the path therebetween is able to shift between a guide position for contacting the sheet or the sheet bunch to guide and a retract position which does not cross the locus of the needle storage section being removed from the binding section so as not to contact the sheet or the sheet bunch.

4. The sheet post-processing apparatus according to claim 2, wherein the receiving section includes a pair of first and second receiving guide members opposed so as to define a path for contacting the sheet or the sheet bunch fed out of the first folding roller pair to guide, and when the processing unit is in the outside position, the first and second receiving guide members are detachable so as to open the portion crossing the locus of the needle storage section being removed from the binding section, outside the sheet post-processing section.

5. The sheet post-processing apparatus according to claim 2, wherein the receiving section includes a pair of first and second receiving guide members opposed so as to define a path for contacting the sheet or the sheet bunch fed out of the first folding roller pair to guide, and the first and second receiving guide members include notch portions in the portion crossing the locus of the needle storage section being removed from the binding section.

6. The sheet post-processing apparatus according to claim 2, wherein the receiving section includes a pair of first and second receiving guide members opposed so as to define a path for guiding the sheet or the sheet bunch fed out of the first folding roller pair, and when the processing unit is in the outside position, the first and second receiving guide members are separated from the processing unit and are positioned inside the sheet post-processing apparatus, so as to open the locus of the needle storage section being removed from the binding section toward outside to add the binding needle.

* * * * *